US006752335B2

(12) United States Patent
Levia

(10) Patent No.: US 6,752,335 B2
(45) Date of Patent: Jun. 22, 2004

(54) PIVOTING BLOW-GUN

(75) Inventor: Kimothy Levia, Le Bizado (CA)

(73) Assignee: Summit Tool Company, Akron, OH (US)

( * ) Notice: Subject to any disclaimer, the term of this patent is extended or adjusted under 35 U.S.C. 154(b) by 0 days.

(21) Appl. No.: 09/865,024

(22) Filed: May 23, 2001

(65) Prior Publication Data

US 2002/0000480 A1 Jan. 3, 2002

Related U.S. Application Data

(60) Provisional application No. 60/206,432, filed on May 23, 2000.

(51) Int. Cl.[7] ..... B05B 15/08

(52) U.S. Cl. ..... 239/587.3; 239/426; 239/433; 239/525; 239/530; 239/587.1; 239/588; 239/600; 138/120; 138/155; 285/261

(58) Field of Search ..... 239/419, 426, 239/433, 434, 525, 526, 530, 587.1, 587.2, 587.3, 588, 600, 583; 138/119, 120, 155; 285/261, 307, 315

(56) References Cited

U.S. PATENT DOCUMENTS

| | | | | | |
|---|---|---|---|---|---|
| 3,884,419 | A | * | 5/1975 | Geoffray | 239/526 |
| 4,905,965 | A | * | 3/1990 | Dolev | 285/307 |
| 4,919,334 | A | * | 4/1990 | Hartmann et al. | 239/600 |
| 5,832,974 | A | * | 11/1998 | Jou | 239/600 |
| 6,032,878 | A | * | 3/2000 | Lacroix et al. | 239/583 |

* cited by examiner

*Primary Examiner*—Steven J. Ganey
(74) *Attorney, Agent, or Firm*—Renner, Kenner, Greive, Bobak, Taylor & Weber

(57) ABSTRACT

A pivoting blow-gun with a pivoting barrel having sufficient strength to receive pressurized air while at the same time dimensioned to allow the manipulation of the pivoting barrel into non-linear configurations which non-linear configurations are maintainable during use of the blow-gun in order to use the pivoting blow-gun to reach areas which would otherwise be hard to reach. A quick-connect attachment device can be used to permit relatively fast and easy changing of barrels.

19 Claims, 2 Drawing Sheets

PIVOTING BLOW-GUN

RELATED APPLICATION

This application claims priority to a corresponding provisional application U.S. Ser. No. 60/206,432, filed May 23, 2000 in the name of the applicant of this application.

FIELD OF THE INVENTION

This invention relates generally to blow-guns used to remove debris in a work environment and, more specifically, to a pivoting blow-gun having a pivoting barrel dimensioned to be manipulated into non-linear configurations in order to reach areas which might otherwise be difficult or impossible to reach with a non-pivoting barrel.

BACKGROUND OF THE INVENTION

Blow-guns are commonly used to remove debris in a work environment, including for example in the engine compartment of a vehicle. When the area requiring the attention of a blow-gun is directly accessible, a standard linear barrel is generally sufficient. However, certain hard-to-reach or obstructed places may be shielded by the blast of air from the linear barrel of a standard blow-gun. Because areas of use vary greatly, it has been heretofore necessary to have multiple blow-guns of variously configured fixed barrels.

The use of two or more separate blow-guns requires disconnection of a pressurized air hose to the intake of one blow-gun and then subsequent reconnection of the pressurized air hose to the intake of a second blow-gun. This procedure is both time and labor-intensive and often requires a delay in work. Moreover, this procedure is largely unnecessary since the handle of a blow-gun serves the same function (i.e. receiving air from a pressurized air source via the air intake and then distributing the air to the barrel attachment) regardless of the barrel attached thereto.

A single blow-gun having a pivoting barrel capable of achieving non-linear configurations can respond to any number of different situations in a work environment, without the cost and inconvenience of maintaining a plurality of blow-guns having differently-configured fixed barrels. Similarly, a blow-gun with a quick-connect attachment device can allow for the easy swapping of barrel attachments, such as pivoting, telescoping, swiveling, fixed length, etc., thus enabling the use of a single blow-gun with many attachments instead of multiple separate blow-gun units.

A need therefore existed for a blow-gun having a quick-connect attachment device capable of coupling to, among other barrels, a pivoting barrel with sufficient strength to act as a barrel for a blow-gun, while at the same time allowing the manipulation of the barrel into non-linear configurations which could then be maintained during use of the blow-gun.

SUMMARY OF THE INVENTION

An object of the present invention is to provide a pivoting blow-gun with a pivoting barrel having sufficient strength to act as a barrel for a blow-gun, while also allowing the manipulation of the pivoting barrel into non-linear configurations which would then be maintained during use of the blow-gun and the passage of air through the barrel.

It is a further object of the present invention to provide a blow-gun with a quick-connect attachment device to allow for the easy swapping of barrel attachments, thus enabling the use of a single blow-gun handle unit with a plurality of attachments.

BRIEF DESCRIPTION OF THE PREFERRED EMBODIMENTS

In accordance with one embodiment of the present invention, a pivoting blow-gun is disclosed, comprising, in combination, a handle having an intake end and an outtake end and a trigger disposed therebetween, the handle is dimensioned to receive pressurized air through the intake end and deliver the pressurized air through the outtake end, the trigger is dimensioned to regulate the flow of the pressurized air, and a pivoting barrel coupled to the outtake end of the handle, the pivoting barrel having sufficient strength to receive pressurized air from the outtake end of the handle while at the same time the pivoting barrel is dimensioned to allow the manipulation of the pivoting barrel into non-linear configurations, the non-linear configurations are maintainable during passage of air through the pivoting barrel.

In accordance with another embodiment of the present invention, a blow-gun is disclosed, comprising, in combination, a handle having an intake end and an outtake end and a trigger disposed therebetween, the handle is dimensioned to receive pressurized air through the intake end and deliver the pressurized air through the outtake end, the trigger is dimensioned to regulate the flow of the pressurized air, a barrel having an intake end and an outtake end; and a quick-connect attachment device comprising two mating members, one of the mating members being located on the outtake end of the handle and a corresponding other of the two mating members being located on the intake end of the barrel.

In accordance with yet another embodiment of the present invention, a blow-gun useful in cleaning operations is disclosed. The blow-gun comprises, in combination: a handle having an intake end and an outtake end and a trigger disposed therebetween, the handle is dimensioned to receive air through the intake end and deliver the air through the outtake end, the trigger is dimensioned to regulate the flow of the air; a pivoting barrel coupled to the outtake end of the handle, the pivoting barrel having sufficient strength to receive air from the outtake end of the handle while at the same time the pivoting barrel is dimensioned to allow the manipulation of the pivoting barrel into non-linear configurations, the non-linear configurations are maintainable during passage of air through the pivoting barrel; and a cleaning solution hose coupled proximate the outtake end of the handle so as to permit mixing of cleaning solution passing therethrough with the air and discharge of the cleaning solution and the air through the barrel.

The foregoing and other objects, features, and advantages of the invention will be apparent from the following, more particular description of the preferred embodiments of the invention, as illustrated in the accompanying drawings.

DETAILED DESCRIPTION OF THE PREFERRED EMBODIMENTS

Figure 1:
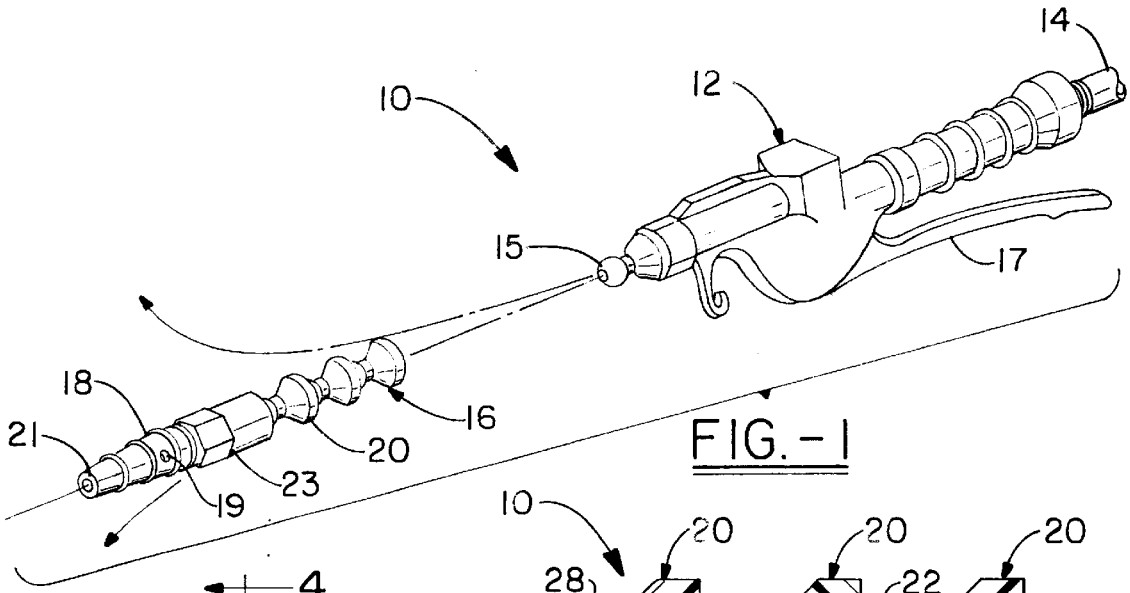
FIG. 1 is a perspective, partially exploded view of an embodiment of the pivoting blow-gun of the present invention.
Figure 2:
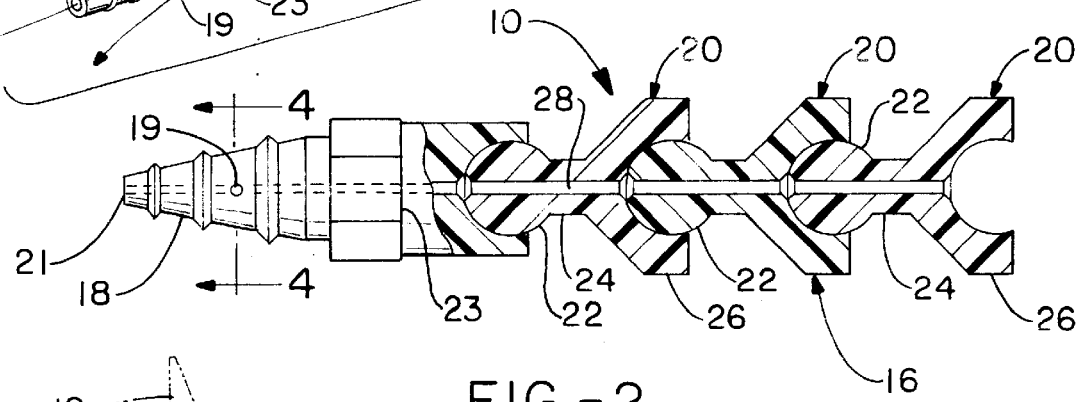
FIG. 2 is a side, partially cross-sectional view of the pivoting blow-gun of FIG. 1.
Figure 3:
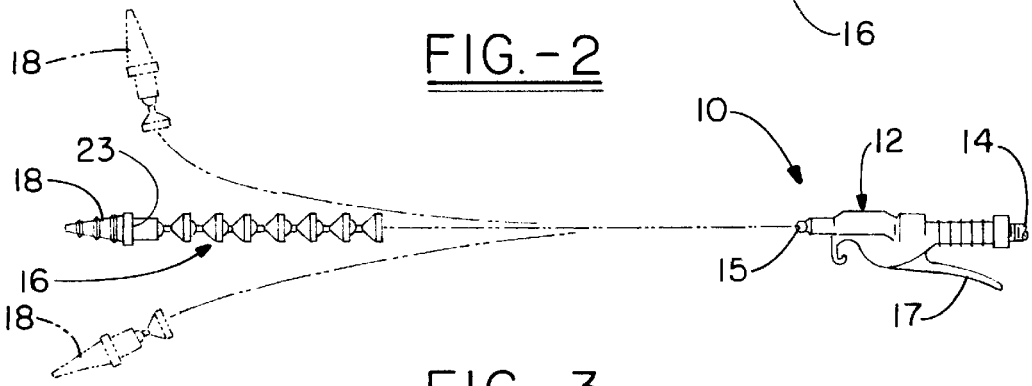
FIG. 3 is a side, partially exploded view of the pivoting blow-gun of FIG. 1, illustrating flexing of the blow-gun.

Referring first to FIGS. 1–3, reference number 10 refers generally to one embodiment of the pivoting blow-gun of the present invention. The pivoting blow-gun 10 generally comprises a handle 12 of the type known in the art. The handle 12 has an intake end 14 and an outtake end 15 and a trigger 17 disposed therebetween. The handle 12 is dimensioned to receive pressurized air through the intake end 14 and deliver the pressurized air through the outtake end 15. The trigger 17 is dimensioned to regulate the flow of the pressurized air. The pivoting blow-gun 10 further comprises a pivoting barrel 16 coupled to the outtake end 15 of the handle 12. The pivoting barrel 16 has sufficient strength to receive pressurized air from the outtake end 15 of the handle 12 while at the same time the pivoting barrel 16 is dimensioned to allow the manipulation of the pivoting barrel 16 into non-linear configurations, which non-linear configurations could then be maintained during use of the pivoting blow-gun 10 and the passage of air through the pivoting barrel 16.

Figure 4:
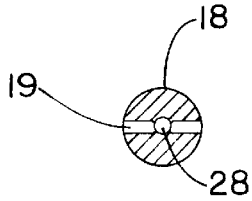
FIG. 4 is a cross-sectional view of the pivoting blow-gun of FIG. 2, taken along line 4—4.

In the preferred embodiment, the pivoting blow-gun 10 further comprises a tip 18 having an intake end 23 and an outtake end 21. The intake end 23 of the tip 18 is coupled at an end of the pivoting barrel 16 opposite the handle 12. The outtake end 21 of the tip 18 is narrower than the intake end 23 of the tip 18 resulting in a more pressurized air flow exiting the outtake end of the tip 18. The tip 18 preferably has a safety by-pass opening 19 therethrough (see FIG. 4) to allow an exit for the pressurized air in the event that the outtake end 21 of the tip 18 becomes obstructed. While, in the preferred embodiment, the pivoting blow-gun 10 comprises a tip 18 with a safety by-pass opening 19, it should be clearly understood that substantial benefit could be derived from an alternative configuration of the pivoting blow-gun 10 which either lacks a tip 18 or which comprises a tip 18 without a safety by-pass opening 19.

The pivoting barrel 16 is comprised of any material or combination of materials having sufficient strength to act as a barrel for a blow-gun, while also allowing the manipulation of the pivoting barrel 16 into non-linear configurations, which non-linear configurations would then be maintained during use of the pivoting blow-gun 10 and the passage of air through the pivoting barrel 16.

In the preferred embodiment, the pivoting barrel 16 is comprised of a plurality of hard-plastic interlocking members 20, although it should be understood that materials other than hard-plastic may be used so long as the material has sufficient strength to act as a barrel for a blow-gun, while also allowing the manipulation of the pivoting barrel 16 into non-linear configurations, which non-linear configurations could then be maintained during use of the pivoting blow-gun 10. As best shown in FIG. 2, each interlocking member 20 comprises a substantially spherical projection 22, a substantially triangular base 26, and a sleeve 24 joining the spherical projection 22 to the triangular base 26. (Each individual interlocking member 20 is preferably injection-molded.) A channel 28 extends through the interior of the interlocking member 20, through each of the spherical projection 22, the triangular base 26, and the sleeve 24. As shown in FIG. 2, the channel 28 broadens at the base of the spherical projection 22 and at the top of the triangular base 26, so that the channel 28 remains open during pivoting of the interlocking members 20 relative to each other, discussed below.

As shown in FIG. 2, the triangular base 26 has an opening in the bottom portion thereof that is dimensioned to receive and retain a spherical projection 22 from a second interlocking member 20. The fit between the spherical projection 22 and the triangular base 26 is such that the spherical projection 22 cannot be pulled from the triangular base 26 without the application of a relatively high amount of force not likely to be encountered during typical use of the pivoting blow-gun 10—so as to avoid accidental separation of interlocking members 20 during use. At the same time, the fit is sufficiently loose so that the individual interlocking members 20 can be pivoted relative to each other in a horizontal or vertical plane (while still keeping the channel 28 open as discussed above), yet sufficiently tight so that the interlocking members 20 will substantially retain their post-pivoted position during use of the pivoting blow-gun 10. Exemplary positions of the pivoting barrel 16 are shown in FIG. 3, but myriad other configurations are possible. Depending on the particular work environment, it may, for example, be desired to create a particular sharp angle in the pivoting barrel 16, or even a plurality of angles such as an S-shape.

In the preferred embodiment, as discussed herein, the pivoting barrel 16 comprises a plurality of interlocking members 20. While the interlocking members 20 preferably have the configuration shown and described herein, a virtually infinite number of geometric configurations could yield substantially the same result, and this invention is by no means limited to the specific configuration shown in FIG. 2. (Whether the interlocking members 20 have the configuration shown and described herein or some other configuration, a further advantage to the use of interlocking members 20 is that the length of the pivoting barrel 16 may be modified, as desired, by adding or removing any number of the interlocking members 20.) Moreover, a tubing material having substantially the same qualities of flexibility—i.e., allowing bending, etc.—and rigidity—i.e., the barrel remains substantially in position in use after being bent—could also be used without departing from the spirit or scope of this invention.

Figure 6:
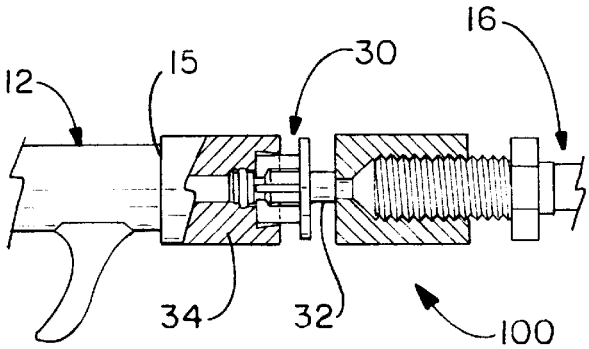
FIG. 6 is a side, partially cross-sectional view of the pivoting blow-gun of FIG. 5 about the attachment point between the barrel and handle.
Figure 5:
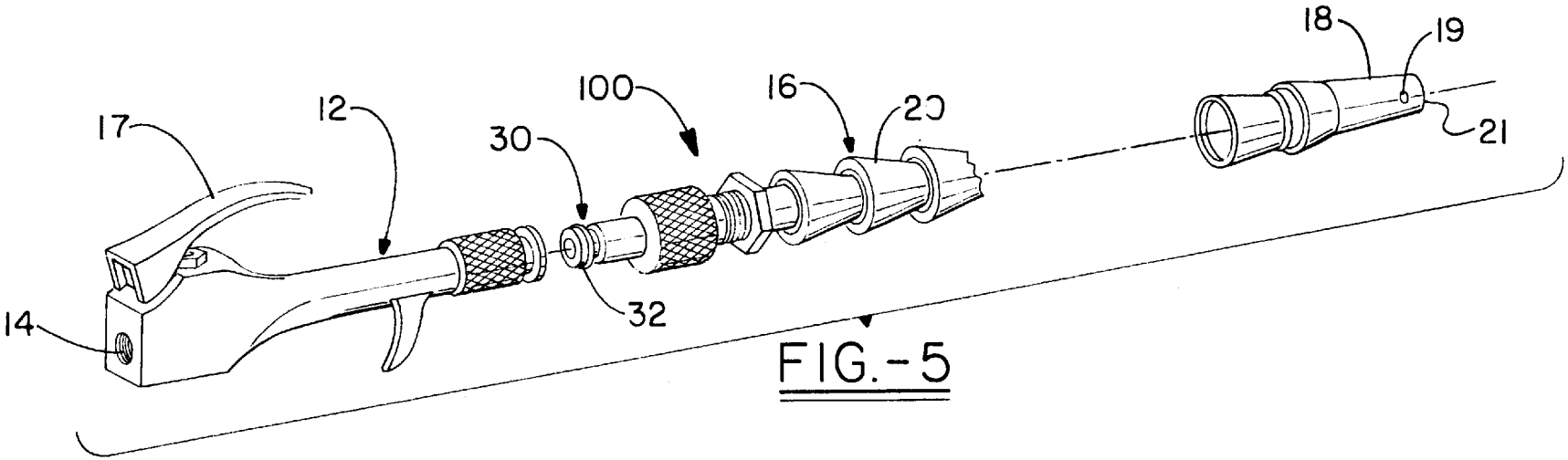
FIG. 5 is a perspective, partially exploded view of another embodiment of the pivoting blow-gun of the present invention, showing the quick-connect attachment device coupling the barrel and handle unit.

Referring now to FIGS. 5–6, an alternative embodiment of the pivoting blow-gun 10, hereinafter 100, is shown. The pivoting blow-gun 100 is substantially the same as before, except that a quick-connect attachment device 30 is used to couple the handle 12 to the barrel 16. The quick-connect attachment device 30 is of the type known in the art. The quick-connect attachment device 30 consists of a male member 32, preferably located at the base of the pivoting barrel 16, and a corresponding a female member 34 located at the outtake end 15 of the handle 12. (Of course, the location of the male member 32 and female member 34 could be reversed.) In the preferred embodiment of the pivoting blow-gun 100, the barrel coupled to the quick-connect attachment device 30 is the same pivoting barrel 16 described in the pivoting blow-gun 10, above. However, it should be clearly understood that one benefit of the quick-connect attachment device 30 is that a variety of different barrels, such as telescopic, fixed, swiveling, etc. can be easily swapped for one another in the blow-gun 100 using the quick-connect attachment device 30, provided that such barrel has thereon the mating member needed to couple with the quick-connect member located on the handle 12.

While the invention has been particularly shown and described with reference to preferred embodiments thereof, it will be understood by those skilled in the art that the foregoing and other changes in form and details may be made therein without departing from the spirit and scope of the invention.

Figure 7:
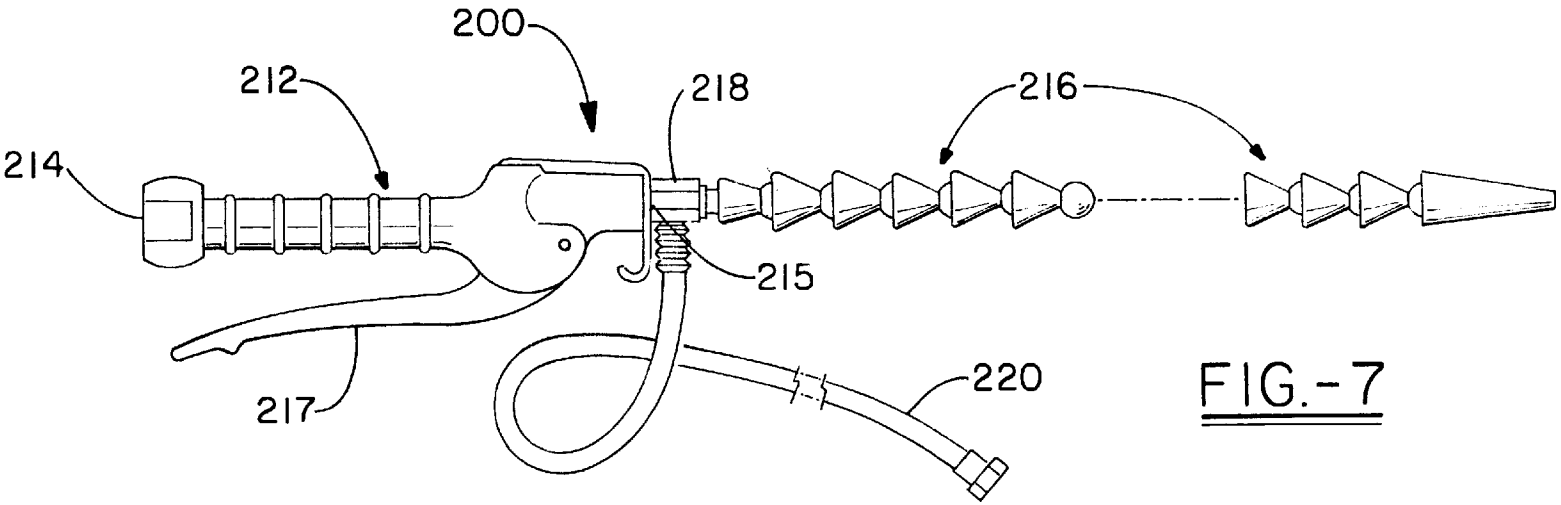
FIG. 7 is a side view of a blow-gun having a shampoo dispensing attachment coupled thereto.

For example, the blow gun 10 or 100 may be used to discharge air—alone or in combination with other matter. For example, FIG. 7 illustrates a side view of a blow gun 200, which is adapted to discharge air. The blow gun 200 comprises a handle 212 having an intake end 214 and an outtake end 215 and a trigger 217 disposed therebetween. The handle 212 is dimensioned to receive air through the intake end 214 and deliver the air through the outtake end 215. The trigger 217 is dimensioned to regulate the flow of the air. A barrel 216, constructed like the barrel 16 described above, is coupled to a two-in-one coupler 218, to which two-in-one coupler 218 is also attached a cleaning solution hose 220. (The cleaning solution hose 220 is, in turn, be coupled to a source of cleaning solution (not shown). The two-in-one coupler 218 is positioned at the outtake end 215 of the handle 212.

As air, is discharged through the outtake end 215 of the handle 212 and into the barrel 216 through the two-in-one coupler 218, cleaning solution is drawn through the cleaning solution hose 220 in the direction of the two-in-one coupler 218. The cleaning solution and air will mix and be dispensed through the barrel 216. In this manner, a cleaning solution can be applied to an area that cannot readily be reached using a linear barrel.

I claim:

1. A pivoting blow-gun, comprising, in combination:

a handle having an intake end and an outtake end and a trigger disposed therebetween, said handle is dimensioned to receive pressurized air through said intake end and deliver said pressurized air through said outtake end, said trigger is dimensioned to regulate the flow of said pressurized air; and a pivoting barrel coupled to said outtake end of said handle, said pivoting barrel having sufficient strength to receive pressurized air from said outtake end of said handle while at the same time said pivoting barrel is dimensioned to allow the manipulation of said pivoting barrel into non-linear configurations, said non-linear configurations are maintainable during passage of air through said pivoting barrel.

2. The pivoting blow-gun of claim 1 further comprising a tip having an intake end and an outtake end, said intake end of said tip is coupled to an end of said pivoting barrel opposite said handle and said outtake end of said tip is narrower than said intake end of said tip resulting in a more pressurized air flow exiting said outtake end of said tip.

3. The pivoting blow-gun of claim 2 wherein said tip defines a safety by-pass opening dimensioned to allow pressurized air to exit said opening when said outtake end of said tip becomes obstructed.

4. The pivoting blow-gun of claim 1 wherein said pivoting barrel comprises a plurality of interlocking members.

5. The pivoting blow-gun of claim 4 wherein each said plurality of interlocking members comprises:

a substantially spherical projection;

a substantially triangular base; and a sleeve joining said spherical projection to said triangular base.

6. The pivoting blow-gun of claim 5 wherein said plurality of interlocking members are made of hard-plastic and injection-molded.

7. The pivoting blow-gun of claim 5 wherein said pivoting barrel defines a channel extending through an interior portion of said substantially spherical projection and through an interior portion of said substantially triangular base and through an interior portion of said sleeve.

8. The pivoting barrel of claim 7 wherein said channel broadens between a base of said spherical projection and a top of said triangular base in order to remain open during pivoting of said interlocking members relative to each other.

9. The pivoting blow-gun of claim 8 wherein said substantially spherical projection and said substantially triangular base are coupled sufficiently loose to permit said interlocking members to be pivoted relative to each other in a horizontal or vertical plane while maintaining said channel in an open position and at the same time said substantially spherical projection and said substantially triangular base are coupled sufficiently tight to permit said interlocking members to retain a post-pivoted position during use of said pivoting blow-gun.

10. A blow-gun, comprising, in combination:

a handle having an intake end and an outtake end and a trigger disposed therebetween, said handle is dimensioned to receive pressurized air through said intake end and deliver said pressurized air through said outtake end, said trigger is dimensioned to regulate the flow of said pressurized air;

a pivoting barrel having an intake end and an outtake end, said pivoting barrel having sufficient strength to receive pressurized air from said outtake end of said handle while at the same time said pivoting barrel is dimensioned to allow the manipulation of said pivoting barrel into non-linear configurations, said non-linear configurations are maintainable during passage of air through said pivoting barrel; and a quick-connect attachment device comprising two mating members, one of said mating members being located on said outtake end of said handle and a corresponding other of said two mating members being located on said intake end of said barrel.

11. The blow-gun of claim 10, further comprising a tip having an intake end and an outtake end, said intake end of said tip is coupled to an end of said pivoting barrel opposite said handle and said outtake end of said tip is narrower than said intake end of said tip resulting in a more pressurized air flow exiting said outtake end of said tip.

12. The blow-gun of claim 11 wherein said tip defines a safety by-pass opening dimensioned to allow pressurized air to exit said opening when said outtake end of said tip becomes obstructed.

13. The blow-gun of claim 10 wherein said pivoting barrel comprises a plurality of interlocking members.

14. The blow-gun of claim 13 wherein each said plurality of interlocking members comprises:

a substantially spherical projection;

a substantially triangular base; and a sleeve joining said spherical projection to said triangular base.

15. The blow-gun of claim 14 wherein said plurality of interlocking members are made of hard-plastic and injection-molded.

16. The blow-gun of claim 14 wherein said pivoting barrel defines a channel extending through an interior portion of said substantially spherical projection and through an interior portion of said substantially triangular base and through an interior portion of said sleeve.

17. The pivoting barrel of claim 16 wherein said channel broadens between a base of said spherical projection and a top of said triangular base in order to remain open during pivoting of said interlocking members relative to each other.

18. The blow-gun of claim 17 wherein said substantially spherical projection and said substantially triangular base are coupled sufficiently loose to permit said interlocking members to be pivoted relative to each other in a horizontal or vertical plane while maintaining said channel in an open position and at the same time said substantially spherical projection and said substantially triangular base are coupled sufficiently tight to permit said interlocking members to retain a post-pivoted position during use of said pivoting blow-gun.

19. A blow-gun useful in cleaning operations comprising, in combination:

a handle having an intake end and an outtake end and a trigger disposed therebetween, said handle is dimensioned to receive air through said intake end and deliver said air through said outtake end, said trigger is dimensioned to regulate the flow of said air;

a pivoting barrel coupled to said outtake end of said handle, said pivoting barrel having sufficient strength to receive air from said outtake end of said handle while at the same time said pivoting barrel is dimensioned to allow the manipulation of said pivoting barrel into non-linear configurations, said non-linear configurations are maintainable during passage of air through said pivoting barrel; and a cleaning solution hose coupled proximate said outtake end of said handle so as to permit mixing of cleaning solution passing therethrough with said air and discharge of said cleaning solution and said air through said barrel.

* * * * *